US010123612B2

(12) United States Patent
Grappe

(10) Patent No.: US 10,123,612 B2
(45) Date of Patent: Nov. 13, 2018

(54) RETRACTABLE SUPPORT MEMBER

(71) Applicant: James Daniel Grappe, Austin, TX (US)

(72) Inventor: James Daniel Grappe, Austin, TX (US)

( * ) Notice: Subject to any disclaimer, the term of this patent is extended or adjusted under 35 U.S.C. 154(b) by 0 days.

(21) Appl. No.: 15/708,392

(22) Filed: Sep. 19, 2017

(65) Prior Publication Data

US 2018/0078033 A1 Mar. 22, 2018

Related U.S. Application Data

(60) Provisional application No. 62/396,673, filed on Sep. 19, 2016.

(51) Int. Cl.

| | |
|---|---|
| ***F16M 11/00*** | (2006.01) |
| ***A47B 3/091*** | (2006.01) |
| ***A47B 9/20*** | (2006.01) |
| *A47B 9/14* | (2006.01) |
| *A47B 1/04* | (2006.01) |
| *A47B 3/087* | (2006.01) |
| *A47B 5/06* | (2006.01) |
| *A47B 31/00* | (2006.01) |
| *A47B 3/08* | (2006.01) |

(52) U.S. Cl.

CPC ..... *A47B 3/0917* (2013.01); *A47B 9/20* (2013.01); *A47B 1/04* (2013.01); *A47B 3/087* (2013.01); *A47B 5/06* (2013.01); *A47B 9/14* (2013.01); *A47B 31/00* (2013.01); *A47B 2003/0824* (2013.01)

(58) Field of Classification Search

CPC ..... A47B 3/0916; A47B 3/0912

See application file for complete search history.

(56) References Cited

U.S. PATENT DOCUMENTS

| | | | | |
|---|---|---|---|---|
| 732,585 A | | 6/1903 | Reinhardt | |
| 1,026,097 A | * | 5/1912 | Lewis | E04G 3/26 182/176 |
| 1,669,566 A | | 5/1928 | Larsen | |
| 1,891,734 A | * | 12/1932 | Slee | A47B 3/0912 108/125 |
| 2,912,202 A | | 11/1959 | Petrick | |
| 3,164,351 A | | 1/1965 | Rembowski | |

(Continued)

FOREIGN PATENT DOCUMENTS

DE 20317442 U1 4/2004

OTHER PUBLICATIONS

International Searching Authority, International Search Report and the Written Opinion, International Application No. PCT/US2017/052296, dated Dec. 21, 2017.

*Primary Examiner* — Amy J. Sterling

(74) *Attorney, Agent, or Firm* — Kelly Kordzik; Matheson Keys & Kordzik PLLC

(57) ABSTRACT

A support member that is retractable and then can be extended and locked into place in order to support such item. The locking mechanisms for the support member include at least two push button assemblies. In order to retract the support member, a user pushes in the first push button and slides a first telescoping portion of the support member over a second telescoping portion of the support member, which then automatically pushes in the second push button to complete the retraction of the support member.

20 Claims, 6 Drawing Sheets

(56) References Cited

U.S. PATENT DOCUMENTS

| | | | | |
|---|---|---|---|---|
| 4,171,013 | A | 10/1979 | Clark | |
| 4,719,954 | A | 1/1988 | Curtis et al. | |
| 5,109,778 | A | 5/1992 | Berkowitz et al. | |
| 5,515,574 | A | 5/1996 | Larson | |
| 6,026,751 | A | 2/2000 | Tsai | |
| 6,050,531 | A | 4/2000 | Wilcox | |
| 6,543,733 | B1 * | 4/2003 | Pennington ..... | A47B 3/0912 108/147.21 |
| 6,920,833 | B2 | 7/2005 | Lou-Hao | |
| 6,920,834 | B1 | 7/2005 | Pehta et al. | |
| 6,925,686 | B2 | 8/2005 | Heathcock et al. | |
| 7,395,830 | B2 | 7/2008 | Seo | |
| 7,516,973 | B2 | 4/2009 | Mielke | |
| 7,632,222 | B1 | 12/2009 | Crognale | |
| 8,186,706 | B2 | 5/2012 | Dotsey | |
| 8,424,470 | B2 | 4/2013 | Volin | |
| 8,550,012 | B2 | 10/2013 | Rogers et al. | |
| 2004/0079845 | A1 | 4/2004 | Wilcox | |
| 2009/0308706 | A1 | 12/2009 | Mao | |
| 2011/0101716 | A1 | 5/2011 | Nolte et al. | |
| 2012/0304901 | A1 | 6/2012 | Volin | |
| 2012/0223508 | A1 | 9/2012 | Ohnishi | |

* cited by examiner

RETRACTABLE SUPPORT MEMBER

This application claims the benefit of U.S. provisional patent application Ser. No. 62/396,673, which is hereby incorporated by reference herein.

TECHNICAL FIELD

The present invention relates in general to a support member, and in particular, to a retractable support member.

BACKGROUND INFORMATION

There are many uses for support members that are retractable when the item they are supporting is not in use. For example, portable tables can be made so that the legs of the table can be retracted to lie flat against the underside of the table when it is not in use. However, when the legs are extended for use, they need to be capable of being sufficiently locked in place in order to adequately support the table and any items placed thereon.

Furthermore, such portable tables are often utilized in situations where set up and vice versa need to be performed quickly and efficiently, such as in situations where there are numerous such tables to be utilized. Correspondingly, when the tables no longer need to be utilized, there are situations where their legs then need to be quickly and efficiently retracted for removal of the tables from their location of use and subsequent storage in a stackable manner.

Many mechanisms have been designed for such retractable support members, but which can be relatively difficult to manually retract.

DETAILED DESCRIPTION

Embodiments of the present disclosure provide a support member that is retractable (for example, when the item it is supporting is not in use), and then can be extended and locked into place in order to support such item. The locking mechanisms for the support member include at least two push button assemblies. In order to retract the support member, a user pushes in the first push button and slides a first telescoping portion of the support member over a second telescoping portion of the support member, which then automatically pushes in the second push button to complete the retraction of the support member.

Figure 1:
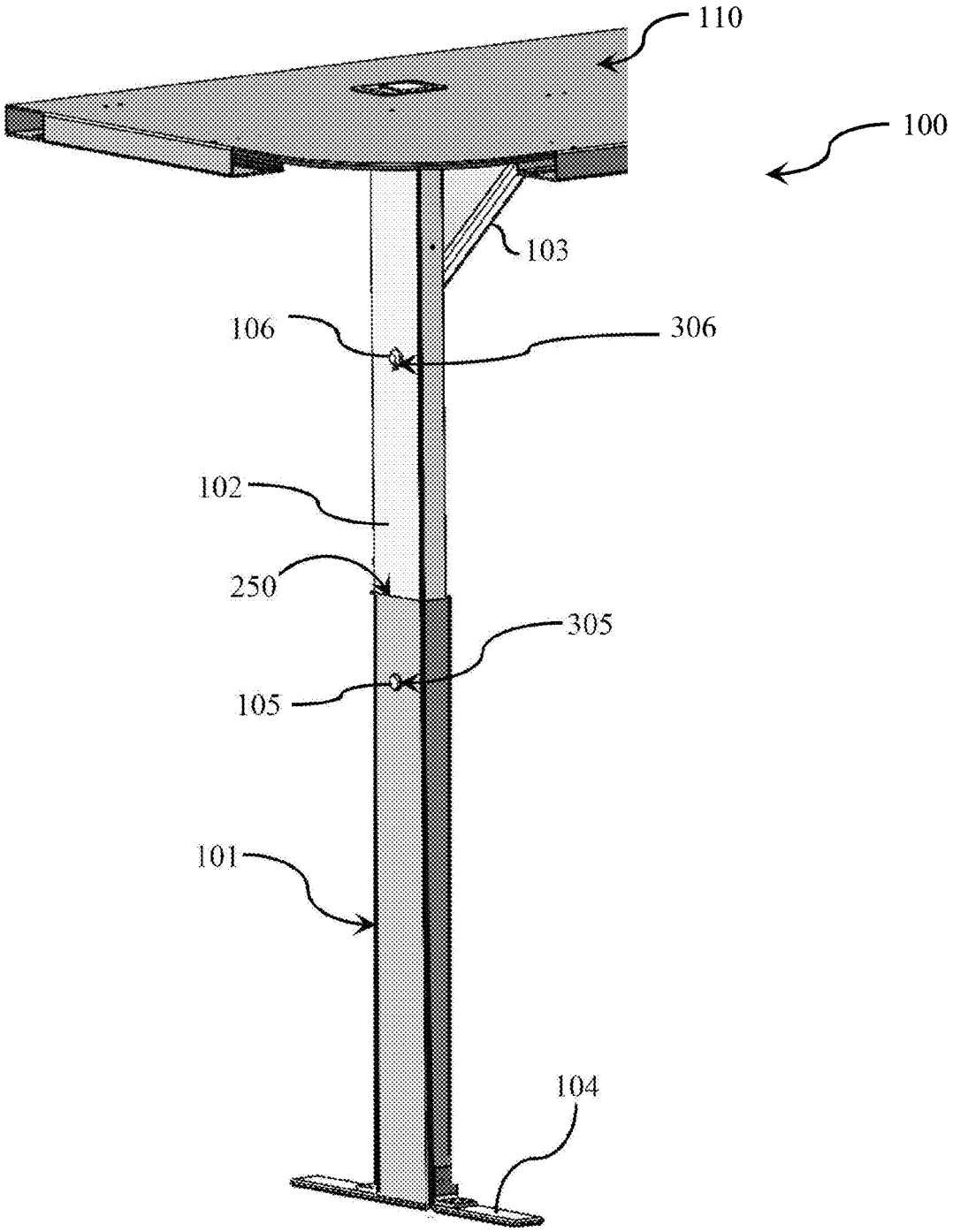
FIG. 1 illustrates an isometric view of a support member configured in accordance with embodiments of the present disclosure.

FIG. 1 illustrates an isometric view of an exemplary application of a retractable support member 100 configured in accordance with embodiments of the present disclosure. In this example, the support member 100 is supporting a planar surface 110, which may be utilized as a table surface, or for any other suitable use. The support member 100 is not limited to supporting such planar or table surfaces, but may be utilized in any other application (such as for supporting an apparatus) in which telescoping support members find a useful application. For example, the support member of embodiments of the present disclosure may be utilized to support any item, such as a portable table, a table-like platform that folds for storage, a portable tent, an awning (e.g., see U.S. Pat. No. 4,171,013), etc.

FIG. 1 shows the support member 100 in an extended configuration, in which the support member 100 is extended and locked into place. At the bottom of the support member 100, an optional foot apparatus 104 may be attached to provide some added stability. Note that the foot apparatus 104 is illustrated in the various embodiments disclosed herein, but is not a necessary aspect of embodiments of the present disclosure.

Furthermore, note that components of the support member 100 may be manufactured from any suitable rigid materials, such as metal, wood, plastic, fiberglass, etc.

The support member 100 includes a lower elongated portion 101 and an upper elongated portion 102. As will be described herein, the upper elongated portion 102 is configured to telescopically slide in relation to the lower elongated portion 101. Though embodiments of the present disclosure are illustrated with the upper and lower elongated portions having a relatively rectangular shape, such upper and lower elongated portions may be configured with any other cross-sectional shape, including square, oval, circular, multi-sided, etc. Nevertheless, in embodiments of the present disclosure, the lower elongated portion 101 and the upper elongated portion 102 are formed so that inside surfaces of the lower elongated portion 101 can telescopically slide over outside surfaces of the upper elongated portion 102, without the two portions becoming disjointed unless the lower elongated portion 101 is completely slid out of the upper elongated portion 102.

A side of the lower elongated portion 101 has a hole 305 formed therethrough so that a depressible push button 105 of a button assembly 205 (see FIGS. 2 and 4) can protrude therethrough. Similarly, the upper elongated portion 102 has a hole 306 formed therethrough so that a depressible push button 106 of a button assembly 206 (see FIGS. 2 and 4-6) can protrude therethrough. In general, such button assemblies are well-known in the art. However, as will be described in further detail hereinafter, the button assembly 206 has been modified in a novel manner.

The support member 100 is further supported by a rigid supporting arm 103 hereinafter described in further detail.

Figure 2:
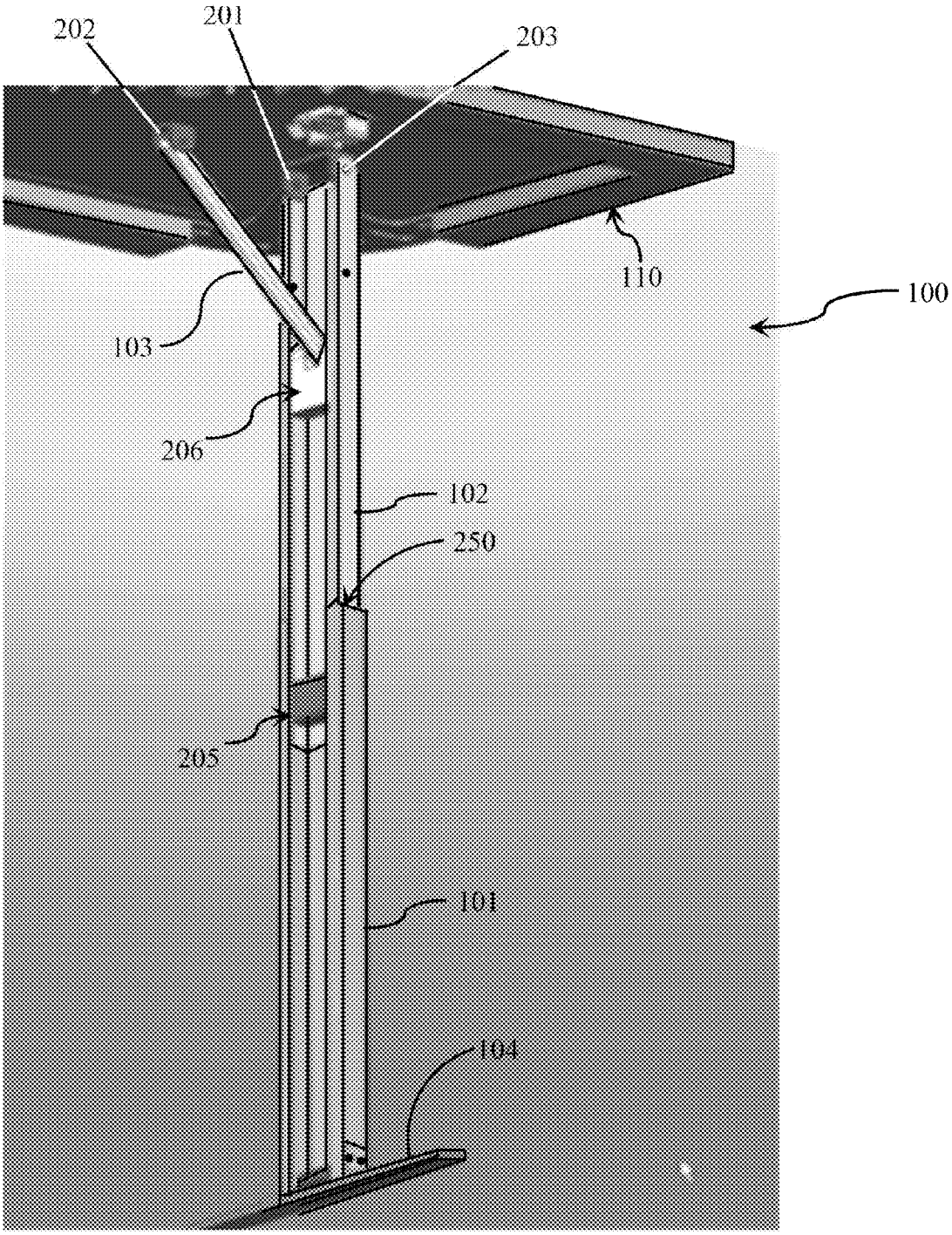
FIG. 2 illustrates an isometric view of the support member of FIG. 1 viewed from the backside of the support member.

FIG. 2 illustrates a backside view of the support member 100 in its extended configuration. The first push button 105 is not shown, but the mechanism in which the push button 105 is contained is illustrated as the button assembly 205, which is rigidly attached to a lower interior of the upper elongated portion 102. When the lower elongated portion 101 is slideably extended, the lower elongated portion 101 will telescopically slide along the outside surfaces of the upper elongated portion 102 until the push button 105 encounters the hole 305 formed in the lower elongated portion 101 so that it protrudes outward through the hole 305. An appropriate well-known spring mechanism (not shown; see, e.g., U.S. Pat. Nos. 6,920,833, 7,395,830, and 8,424,470, and U.S. published patent application no. 2011/0101716 for exemplary spring mechanisms) is located inside the button assembly 205, which is configured to push the push button 105 outwards and thus to force the push button 105 to protrude into the hole 305 of the lower elongated portion 101. The push button 105 is sufficiently large and long enough, and the spring sufficiently strong enough, to force the push button 105 through the hole 305 formed in the lower elongated portion 101 and to maintain the push button 105 being held through that hole 305 so that the lower elongated portion 101 and the upper elongated portion 102 are not able to slide relative to each other without push button 105 being pushed back in the button assembly 205. In other words, the push button 105 protruding through the hole 305 of the lower elongated portion 101 locks the lower elongated portion 101 in relation to the upper elongated portion 102 so that they no longer can slide relative to each other.

A similar button assembly 206 is hingeably coupled with a hinged apparatus 401 (see FIGS. 4-6) to the supporting arm 103, but is permitted to slide within the upper elongated portion 102 (i.e., the second button assembly 206 is slideably engaged with an interior of the upper elongated portion 102). When the depressible push button 106 (not shown) encounters the hole 306 in the upper elongated portion 102, an appropriate well-known spring mechanism (such as previously noted herein) in the button assembly 206 is configured to push the push button 106 outwards and thus force the push button 106 to protrude into that hole 306 to thereby lock in place the position of the button assembly 206 relative to the upper elongated portion 102.

FIG. 2 also shows how the upper elongated portion 102 is hingeably coupled to a bracket 201 affixed to an underneath surface of the platform 110. Some type of appropriate pin or rivets 203 may be utilized to hingeably couple the upper elongated portion 102 to the bracket 201. As will be described with respect to FIG. 3, this hinged coupling between the upper elongated portion 102 and the bracket 201 permits the upper elongated portion 102 to hinge upward towards the underneath surface of the platform 110 being supported by the support member 100.

FIG. 2 also shows how the supporting arm 103 is hingeably coupled to a bracket 202 also affixed to an underneath surface of the platform 110.

Figure 3:
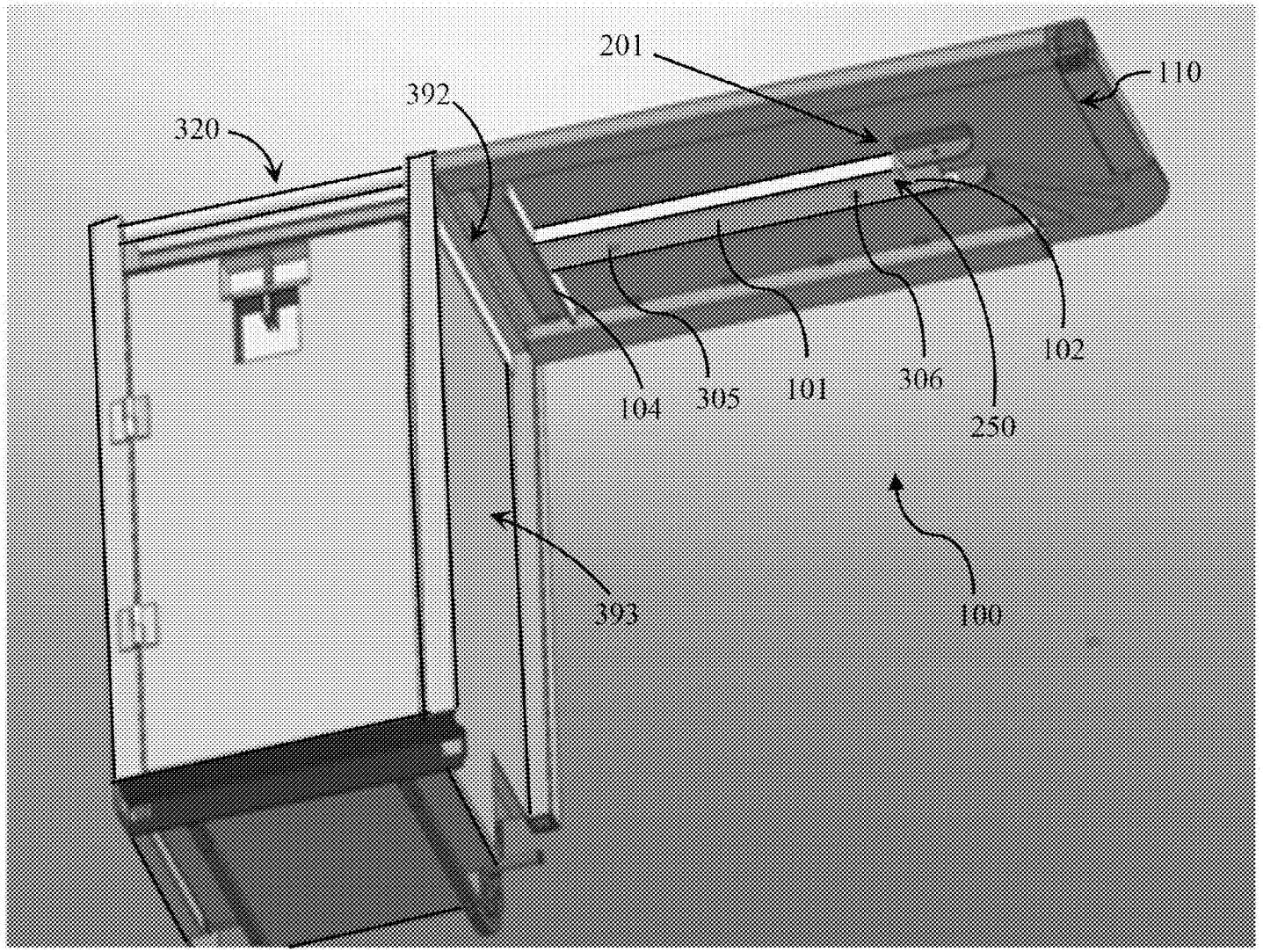
FIG. 3 illustrates an isometric view of the support member of FIG. 1 viewed in an exemplary retractable configuration.

Referring to FIG. 3, there is illustrated an example of the support member 100 in a retracted configuration relative to the platform 110. In this retracted configuration, the support member 100 has been retracted and folded to lie adjacent (e.g., relatively flat against) the underneath surface of the platform 110.

Referring to FIG. 2 and FIG. 3 together, it can be seen how the support member 100 can be retracted to the configuration illustrated in FIG. 3. In order to retract the support member 100 from the extended configuration illustrated in FIG. 2 to the retracted configuration illustrated in FIG. 3, a user will push the push button 105 into the button assembly 205 permitting the lower elongated portion 101 to then telescopically slide upwards over the upper elongated portion 102, since they are no longer fixed relative to each other by the protruding of the push button 105 through the hole 205 in the lower elongated portion 101. When the top edge 250 of the lower elongated portion 101 encounters and physically engages the push button 106 (resulting from the continued sliding upwards of the lower elongated portion 101 over the upper elongated portion 102), the top edge 250 forces inward (retracts) the push button 206 into its button assembly 206, which then frees the button assembly 206 to be able to slide downward inside of the upper elongated portion 102. The lower elongated portion 101 can then be slid further upward over the upper elongated portion 102, and the combination of the upper elongated portion 102 telescopically retracted over the lower elongated portion 101 can then be folded towards and adjacent the underneath surface of the platform 110. Continued sliding of the lower elongated portion 101 over the upper elongated portion 102 maintains the push button 206 in such a retracted configuration (i.e., withdrawn into the button assembly 206). In FIG. 3, the push buttons 105 and 106 are no longer visible; instead, only the holes 305 and 306 through which they formerly protruded are visible.

In the exemplary embodiment shown in FIG. 3, due to the hinged coupling of the platform 110 to the apparatus 320, the platform 110 may then be folded downwards adjacent the side of the apparatus 320. In a non-limiting example, the platform 110 may be configured to function as a planar (e.g., table) surface hingeably coupled by a hinge mechanism 392 to the apparatus 320. The apparatus 320 may be a storage box such as disclosed within the U.S. published patent application no. 2016/0244079, which is hereby incorporated by reference herein. FIG. 3 illustrates the platform 110 positioned away from the surface 393 of the apparatus 320, and (1) ready for the retractable support member 100 to be moved from its shown retracted configuration to an extended configuration (such as shown in FIGS. 1, 2, 4, and 5) in order to support the platform in such an extended configuration, or (2) ready for the assembly of the platform 110 and the retracted support member 100 to be hingeably positioned adjacent to the side 393 of the apparatus 320.

Figure 4:
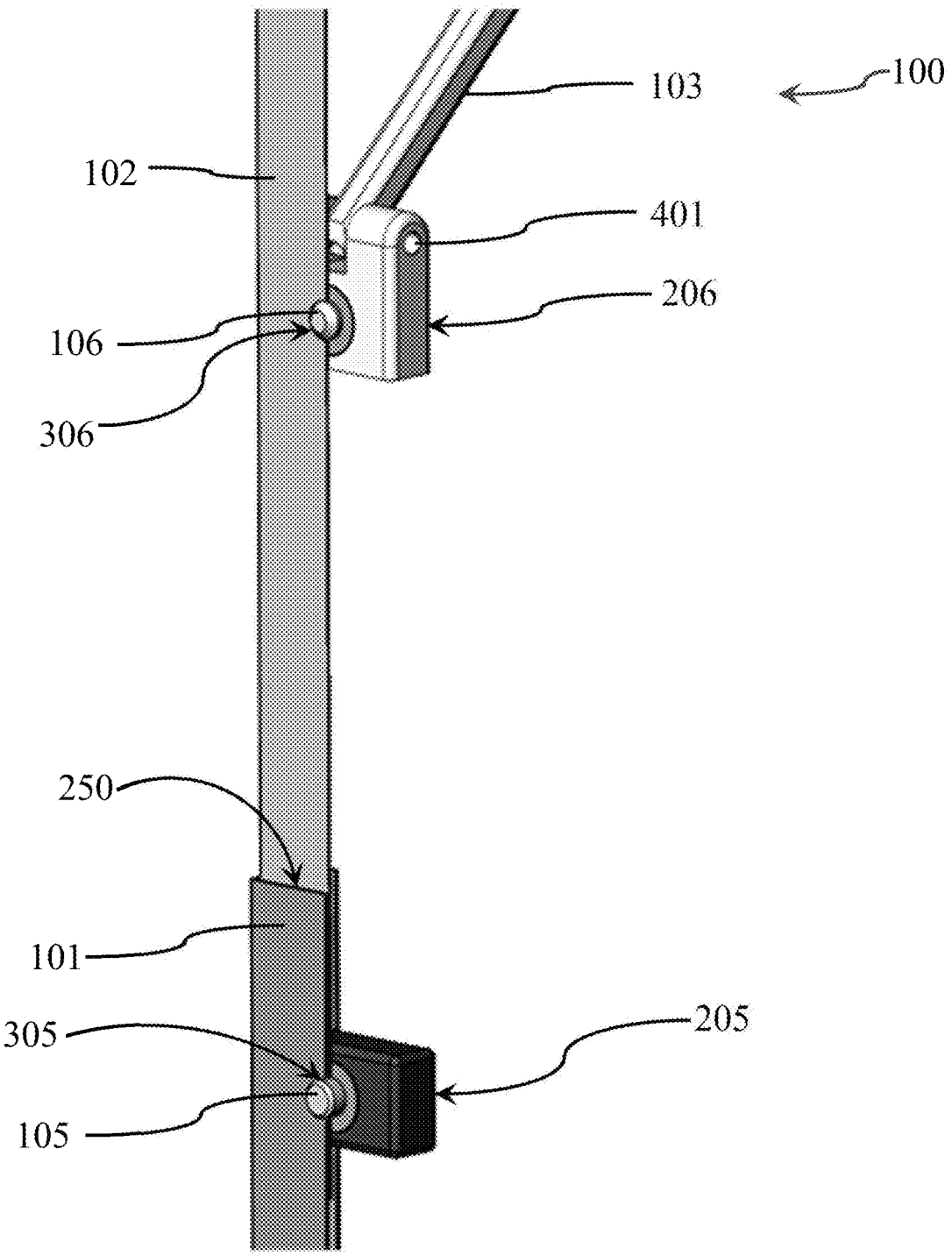
FIG. 4 illustrates a cutaway view of the locking mechanisms used within the support member of FIG. 1.

FIG. 4 illustrates a cutaway view of the upper elongated portion 102 and the lower elongated portion 101 showing how the push buttons 105 and 106 can protrude from their respective button assemblies 205, 206 through the holes 305 and 306, respectively.

Figure 5:
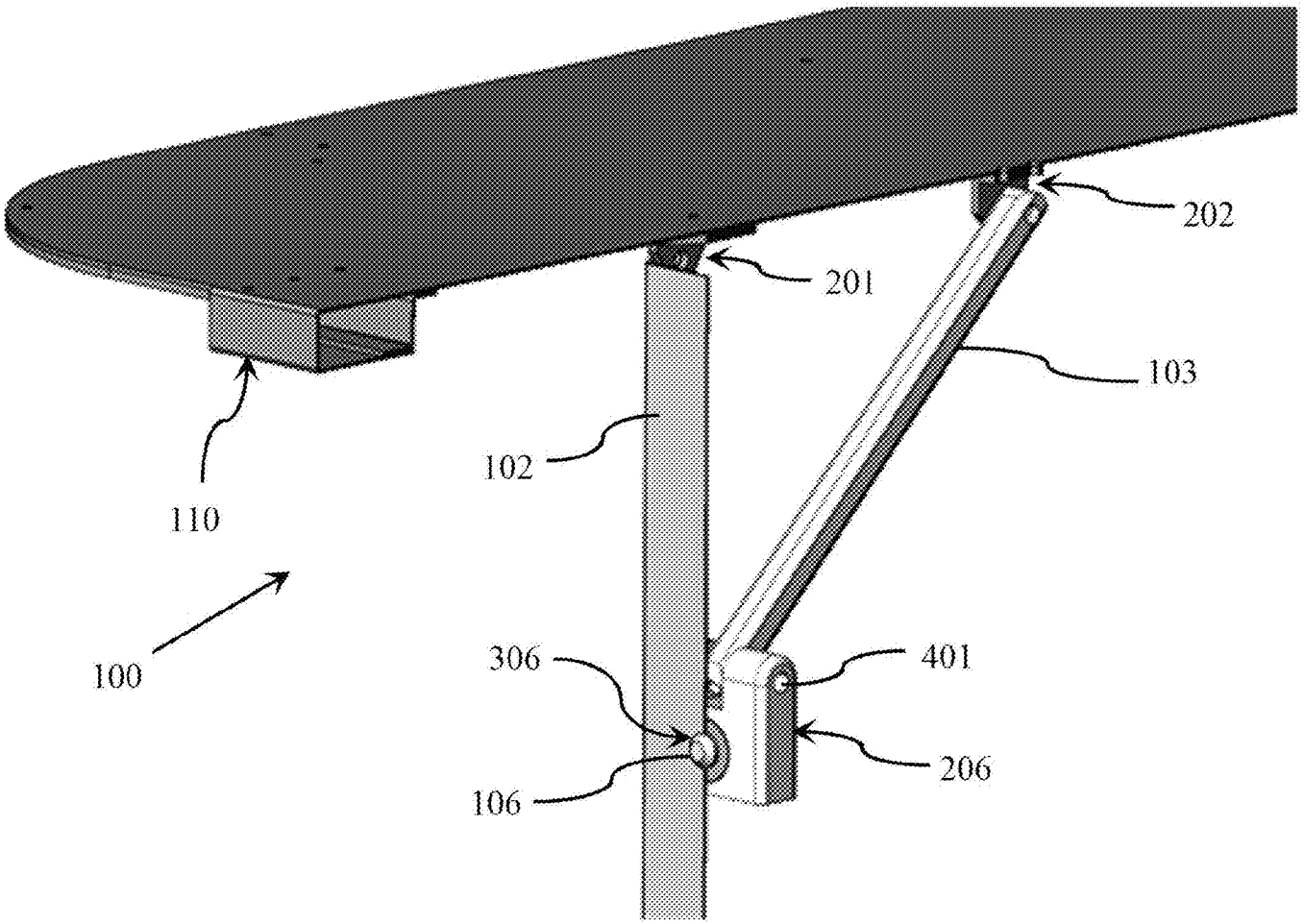
FIG. 5 illustrates another cutaway view of one of the locking mechanisms used within the support member of FIG. 1.

FIG. 5 illustrates another cutaway view of the upper elongated portion 102, showing the push button 106 protruding from its button assembly 206 through the hole 306 formed within the upper elongated portion 102. FIG. 5 shows how once the push button 106 is pushed inward into the interior of its button assembly 206, the button assembly 206 can then slide downward inside the upper elongated portion 102, since it is hingeably coupled to the supporting arm 103, which is also hingeably coupled to the bracket 202 affixed to the underneath surface of the platform 110. FIG. 5 shows the retractable support member in the extended configuration, in which the supporting arm 103 is positioned at a non-parallel angle relative to the upper elongated portion 102.

Figure 6:
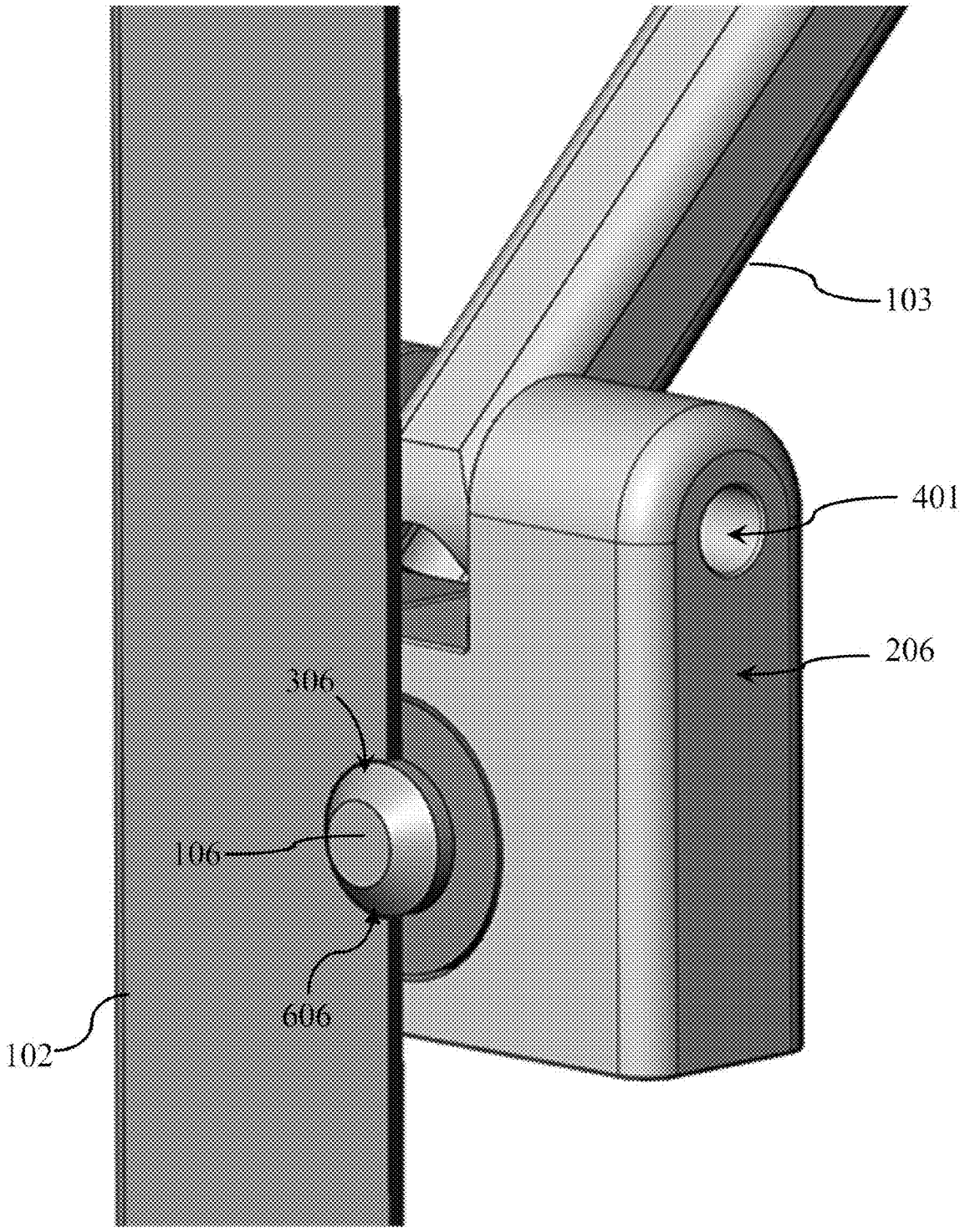
FIG. 6 illustrates a close-up view of one of the locking mechanisms used within the support member of FIG. 1.

FIG. 6 illustrates a close-up view of a portion of the upper elongated portion 102 in a cutaway view showing the push button 106 protruding through the hole 306 formed in the upper elongated portion 102. The push button 106 can be formed with a shape (e.g., a conical shape, truncated conical shape, rounded shape, etc.) so that a side 606 of the push button 106 is ramped, or curved, in a manner that forces the push button 106 into the interior of the button assembly 206 against a spring in the spring mechanism (as previously noted herein), which is configured to apply a force for pushing the push button 106 outward and into the hole 306.

Such a truncated conical shape with a ramped side 606 engages with the top edge 250 (not shown in FIG. 6) of the lower elongated portion 101 when the lower elongated portion 101 is manually telescopically slid over the upper elongated portion 102, thereby forcing the push button inwards and out of the hole 306 to free the button assembly 206 relative to the upper elongated portion 102 so that the button assembly 206 is then permitted to slide downward inside of the upper elongated portion 102. The user can then manually retract the entire support member 100 in a hinged manner to be adjacent the platform 110, since the supporting arm 103 can then push the hingeably coupled button assembly 206 to slide downward inside of the upper elongated portion 102 while the supporting arm 103 also pivots about the bracket 202.

As can be readily appreciated from the foregoing description and the accompanying drawings, including FIGS. 1 and 4, as the lower elongated portion begins to slide upwards onto the upper elongated portion, the second push button will be automatically caused to be pushed in as the upper edge of the lower elongated portion engages with and further slides over the second push button.

Note that within embodiments of the present disclosure, the upper elongated portion is configured to confine the second button assembly to slideable engagement adjacent to or within portions of the upper elongated portion, and wherein the lower elongated portion is configurated to confine the upper elongated portion to slideable engagement adjacent to or within portions of the lower elongated portion.

As has been described herein, embodiments of the present disclosure provide for a retractable support member that enables the user to more easily move a retractable support member from an extended configuration to a retracted configuration, wherein the retractable support member includes an upper elongated portion of the retractable support member; a lower elongated portion of the retractable support member, wherein the upper and lower elongated portions are configured so that the upper elongated portion telescopically slides within the lower elongated portion; a first button assembly rigidly attached to a lower interior of the upper elongated portion, wherein the first button assembly includes a first push button; a second button assembly slideably engaged with an interior of the upper elongated portion of the retractable support member, wherein the second button assembly includes a second push button; a supporting arm having a first end hingeably coupled to the second button assembly, wherein the lower elongated portion has a first hole formed therethrough that is configured to permit the first push button to protrude into the first hole, and wherein the upper elongated portion has a second hole formed therethrough that is configured to permit the second push button to protrude into the second hole; a first bracket hingeably coupled to a second end of the supporting arm; and a second bracket hingeably coupled to a first end of the upper elongated portion, wherein when the retractable support member is in an extended configuration, the upper and lower elongated portions are telescopically and rigidly engaged with each other by the first push button protruding into the first hole and the second push button protruding into the second hole. Such a method includes the user manually pushing the second push button inward a sufficient distance so that the second button assembly is no longer rigidly engaged with the lower elongated portion. When the second button assembly is no longer rigidly engaged with the lower elongated portion, the user then manually slides the upper and lower elongated portions towards each other in a telescopic manner so that a top edge of the lower elongated portion engages with a side of the second push button to thereby automatically push in the second push button a sufficient distance out of the second hole so that the second button assembly is no longer rigidly engaged with the upper elongated portion. In other words, the second push button is automatically pushed in without the user having to manually push the second push button, such as by using the user's fingers. The action of the top edge of the lower elongated portion engaging the truncated conical or curved side of the second push button automatically forces the second push button inward. Then, the user pivots the retractable support member about the second bracket towards the retracted configuration thereby causing the second button assembly to slide within the upper elongated portion. The pivoting of the retractable support member about the second bracket causes the supporting arm to pivot about the first bracket. In the retracted configuration, the supporting arm is substantially parallel to the upper elongated portion. When the retractable support member is in the retracted configuration, the upper and lower elongated portions are telescopically engaged with each other so that the first push button is not protruding into the first hole and the second push button is not protruding into the second hole. In the retracted configuration, the supporting arm, the upper elongated portion, and the lower elongated portion are substantially parallel to the apparatus. In the extended configuration, the supporting arm is positioned at a non-parallel angle relative to the upper elongated portion.

While these exemplary embodiments are described in sufficient detail to enable those skilled in the art to practice the invention, it should be understood that other embodiments may be realized and that various changes to the invention may be made without departing from the spirit and scope of the present invention. Thus, the foregoing more detailed description is not intended to limit the scope of the invention, as claimed, but is presented for purposes of illustration only to describe the features and characteristics of the present invention, and to sufficiently enable one skilled in the art to practice the invention. Accordingly, the scope of the present invention is to be defined solely by the appended claims.

In describing and claiming the present invention, the following terminology will be used. The singular forms "a," "an," and "the" include plural referents unless the context clearly dictates otherwise.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a defacto equivalent of any other member of the same list solely based on their presentation in a common group without indications to the contrary.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

All publications and patent applications are herein incorporated by reference to the same extent as if each individual publication or patent application was specifically and individually indicated to be incorporated by reference.

What is claimed is:

1. A retractable support member, comprising:

an upper elongated portion of the retractable support member;

a lower elongated portion of the retractable support member, wherein the upper and lower elongated portions are configured so that the upper elongated portion telescopically slides within the lower elongated portion;

a first button assembly rigidly attached to a lower interior of the upper elongated portion, wherein the first button assembly includes a first push button;

a second button assembly slideably engaged with an interior of the upper elongated portion of the retractable support member, wherein the second button assembly includes a second push button; and a supporting arm having a first end hingeably coupled to the second button assembly, wherein the lower elongated portion has a first hole formed therethrough that is configured to permit the first push button to protrude into the first hole, and wherein the upper elongated portion has a second hole formed therethrough that is configured to permit the second push button to protrude into the second hole.

2. The retractable support member as recited in claim 1, further comprising:

a first spring mechanism within the first button assembly that is configured to push the first push button outwards;

a second spring mechanism within the second button assembly that is configured to push the second push button outwards.

3. The retractable support member as recited in claim 1, further comprising:

a first bracket hingeably coupled to a second end of the supporting arm; and a second bracket hingeably coupled to a first end of the upper elongated portion.

4. The retractable support member as recited in claim 3, wherein the first and second brackets are suitable for being rigidly attached to an apparatus to be supported by the retractable support member.

5. The retractable support member as recited in claim 1, wherein when the retractable support member is in an extended configuration, the upper and lower elongated portions are telescopically and rigidly engaged with each other by the first push button protruding into the first hole and the second push button protruding into the second hole.

6. The retractable support member as recited in claim 1, wherein when the retractable support member is in a retracted configuration, the upper and lower elongated portions are telescopically engaged with each other so that the first push button is not protruding into the first hole and the second push button is not protruding into the second hole.

7. The retractable support member as recited in claim 1, wherein the second push button is configured to retract into the second button assembly and out of the second hole when it engages with a top edge of the lower elongated portion as the upper elongated portion is telescopically slid into the upper elongated portion.

8. The retractable support member as recited in claim 1, wherein the retractable support member is configured to have an extended configuration and a retracted configuration, wherein when the retractable support member is in the extended configuration, the upper and lower elongated portions are telescopically and rigidly engaged with each other by the first push button protruding into the first hole and the second push button protruding into the second hole, and wherein when the retractable support member is in the retracted configuration, the upper and lower elongated portions are telescopically engaged with each other so that the first push button is not protruding into the first hole and the second push button is not protruding into the second hole.

9. The retractable support member as recited in claim 4, wherein the apparatus is a planar surface hingeably coupled to a storage box, wherein when the retractable support member is in an extended configuration, the upper and lower elongated portions are telescopically and rigidly engaged with each other by the first push button protruding into the first hole and the second push button protruding into the second hole, wherein when the retractable support member is in a retracted configuration, the upper and lower elongated portions are telescopically engaged with each other so that the first push button is not protruding into the first hole and the second push button is not protruding into the second hole, and wherein the retracted configuration, the retractable support member is retracted to be adjacent an underneath of the planar surface, and the planar surface is positioned adjacent to a side of the storage box.

10. A method for moving a retractable support member from an extended configuration to a retracted configuration, wherein the retractable support member comprises:

an upper elongated portion of the retractable support member;

a lower elongated portion of the retractable support member, wherein the upper and lower elongated portions are configured so that the upper elongated portion telescopically slides within the lower elongated portion;

a first button assembly rigidly attached to a lower interior of the upper elongated portion, wherein the first button assembly includes a first push button;

a second button assembly slideably engaged with an interior of the upper elongated portion of the retractable support member, wherein the second button assembly includes a second push button;

a supporting arm having a first end hingeably coupled to the second button assembly, wherein the lower elongated portion has a first hole formed therethrough that is configured to permit the first push button to protrude into the first hole, and wherein the upper elongated portion has a second hole formed therethrough that is configured to permit the second push button to protrude into the second hole;

a first bracket hingeably coupled to a second end of the supporting arm; and a second bracket hingeably coupled to a first end of the upper elongated portion, wherein when the retractable support member is in an extended configuration, the upper and lower elongated portions are telescopically and rigidly engaged with each other by the first push button protruding into the first hole and the second push button protruding into the second hole, the method comprising:

manually pushing the second push button inward a sufficient distance so that the second button assembly is no longer rigidly engaged with the lower elongated portion;

when the second button assembly is no longer rigidly engaged with the lower elongated portion, manually sliding the upper and lower elongated portions towards each other in a telescopic manner so that a top edge of the lower elongated portion engages with a side of the second push button to thereby automatically push in the second push button a sufficient distance out of the second hole so that the second button assembly is no longer rigidly engaged with the upper elongated portion; and pivoting the retractable support member about the second bracket towards the retracted configuration thereby causing the second button assembly to slide within the upper elongated portion.

11. The method as recited in claim 10, wherein the pivoting of the retractable support member about the second bracket causes the supporting arm to pivot about the first bracket.

12. The method as recited in claim 11, wherein the retracted configuration, the supporting arm is substantially parallel to the upper elongated portion.

13. The method as recited in claim 12, wherein when the retractable support member is in the retracted configuration, the upper and lower elongated portions are telescopically engaged with each other so that the first push button is not protruding into the first hole and the second push button is not protruding into the second hole.

14. The method as recited in claim 12, wherein the first and second brackets are suitable for being rigidly attached to an apparatus to be supported by the retractable support member.

15. The method as recited in claim 14, wherein the retracted configuration, the supporting arm, the upper elongated portion, and the lower elongated portion are substantially parallel to the apparatus.

16. The method as recited in claim 15, wherein the extended configuration, the supporting arm is positioned at a non-parallel angle relative to the upper elongated portion.

17. An apparatus comprising:

a retractable support member comprising:

an upper elongated portion of the retractable support member;

a lower elongated portion of the retractable support member, wherein the upper and lower elongated portions are configured so that the upper elongated portion telescopically slides within the lower elongated portion;

a first button assembly rigidly attached to a lower interior of the upper elongated portion, wherein the first button assembly includes a first push button;

a second button assembly slideably engaged with an interior of the upper elongated portion of the retractable support member, wherein the second button assembly includes a second push button;

a supporting arm having a first end hingeably coupled to the second button assembly, wherein the lower elongated portion has a first hole formed therethrough that is configured to permit the first push button to protrude into the first hole, wherein the upper elongated portion has a second hole formed therethrough that is configured to permit the second push button to protrude into the second hole, a first bracket hingeably coupled to a second end of the supporting arm; and a second bracket hingeably coupled to a first end of the upper elongated portion, wherein the retractable support member is configured to have an extended configuration and a retracted configuration, wherein when the retractable support member is in the extended configuration, the upper and lower elongated portions are telescopically and rigidly engaged with each other by the first push button protruding into the first hole and the second push button protruding into the second hole, wherein when the retractable support member is in the retracted configuration, the upper and lower elongated portions are telescopically engaged with each other so that the first push button is not protruding into the first hole and the second push button is not protruding into the second hole; and a surface, wherein the first and second brackets are attached to the surface.

18. The apparatus as recited in claim 17, wherein the second push button is configured to retract into the second button assembly and out of the second hole when it engages with a top edge of the lower elongated portion as the upper elongated portion is telescopically slid into the upper elongated portion.

19. The apparatus as recited in claim 18, wherein the retracted configuration, the supporting arm, the upper elongated portion, and the lower elongated portion are substantially parallel to the apparatus, and wherein the extended configuration, the supporting arm is positioned at a non-parallel angle relative to the upper elongated portion.

20. The apparatus as recited in claim 17, wherein the upper elongated portion is configured to confine the second button assembly to slideable engagement within the upper elongated portion, and wherein the lower elongated portion is configured to confine the upper elongated portion to slideable engagement within the lower elongated portion.

* * * * *